US007659490B2

(12) United States Patent
Beilke

(10) Patent No.: US 7,659,490 B2
(45) Date of Patent: Feb. 9, 2010

(54) SYSTEMS FOR PROCESSING PLATE-LIKE WORKPIECES

(75) Inventor: Hans-Jochen Beilke, Koengen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 157 days.

(21) Appl. No.: 11/522,062

(22) Filed: Sep. 15, 2006

(65) Prior Publication Data

US 2007/0051705 A1 Mar. 8, 2007

Related U.S. Application Data

(63) Continuation of application No. PCT/EP2005/001532, filed on Feb. 16, 2005.

(30) Foreign Application Priority Data

Mar. 17, 2004 (EP) ..... 04006283

(51) Int. Cl.
*B23K 26/14* (2006.01)
*B23K 26/16* (2006.01)

(52) U.S. Cl. ..... 219/121.67; 219/121.72

(58) Field of Classification Search ..... 219/121.67, 219/212.72, 121.85, 121.6; 72/380
See application file for complete search history.

(56) References Cited

U.S. PATENT DOCUMENTS

| | | | | | |
|---|---|---|---|---|---|
| 4,242,898 | A | * | 1/1981 | Salvagnini | 72/307 |
| 4,385,513 | A | * | 5/1983 | Salvagnini | 72/320 |
| 4,455,857 | A | * | 6/1984 | Salvagnini | 72/320 |
| 4,467,633 | A | * | 8/1984 | McEwen et al. | 72/203 |
| 4,682,401 | A | | 7/1987 | Tadashi et al. | |
| 5,359,872 | A | * | 11/1994 | Nashiki | 72/16.1 |
| 6,013,017 | A | * | 1/2000 | Aizawa | 483/29 |
| 6,185,974 | B1 | | 2/2001 | Venturini | |

FOREIGN PATENT DOCUMENTS

| | | |
|---|---|---|
| DE | 19720478 | 11/1997 |
| EP | 1 287 917 | 3/2003 |

* cited by examiner

*Primary Examiner*—M. Alexandra Elve
(74) *Attorney, Agent, or Firm*—Fish & Richardson P.C.

(57) ABSTRACT

A system for processing plate-like workpieces, especially metal sheets, comprises a first processing device in the form of a cutting device and also a second processing device, on which a processing line is defined. By means of a workpiece bed of a longitudinal guide a workpiece is movable relative to the cutting device in a first axial direction extending in a longitudinal direction of the processing line into a processing position. The cutting device, together with a workpiece bed of a transverse guide in an inoperative state, is movable relative to a workpiece in a second axial direction extending in a direction transverse to the processing line and thus transferable into a processing position.

18 Claims, 10 Drawing Sheets

SYSTEMS FOR PROCESSING PLATE-LIKE WORKPIECES

RELATED APPLICATIONS

This application is a continuation of, and claims priority under 35 U.S.C. §120 to PCT/EP2005/001532, filed on Feb. 16, 2005, and designating the U.S., and claims priority under 35 U.S.C. § 119 from European application EP 04 006 283.8, filed Mar. 17, 2004. Both of these priority applications are hereby incorporated by reference in their entirety.

TECHNICAL FIELD

This invention relates to systems for processing plate-like workpieces, such as metal sheets.

BACKGROUND

A system for processing plate-like workpieces, especially metal sheets, can in some cases include (a) a first processing device for workpiece processing, in the form of a cutting device, (b) a second processing device for workpiece processing wherein a processing line is defined on the second processing device, (c) a longitudinal guide, which has a workpiece bed which, together with a workpiece, is movable relative to the cutting device in a first axial direction extending in the longitudinal direction of the processing line, and also (d) a transverse guide which has a workpiece bed which, in an operating state is movable together with a workpiece relative to the second processing device, and in an inoperative state is movable relative to a workpiece, in each case in a second axial direction extending in a direction transverse to the processing line.

Such a system is disclosed in EP 1 287 917 A1, in which the cutting device may be a punching device consisting of two punching units. and the second processing device is a bending device which defines a bending line (the processing line). The two punching units of the punching device are movable in opposite directions along the bending line defined on the bending device. Also running along the bending line associated with the bending device are belt conveyors, by means of which workpieces to be processed are fed in and processed workpieces are conveyed away. A workpiece manipulator travels in a direction transverse to the bending line.

In use, a metal sheet to be processed is first conveyed by the respective belt conveyor along the bending line of the bending device into a starting position, from which a thruster moves the metal sheet in a direction transverse to the bending line towards the punching device. The punching units and the metal sheet are then adjusted relative to one another with the punching units being moved along the bending line. The metal sheet is then taken up by the workpiece manipulator and transferred in a direction transverse to the bending line relative to the punching units into at least one processing position for cutting processing (punching). Following the punching operation(s), the workpiece manipulator, with the metal sheet, moves towards the bending device, which then bends a portion of the workpiece.

SUMMARY

In one aspect, the disclosure features a system for processing plate-like workpieces comprising, (a) a first processing device for workpiece processing comprising a cutting device, (b) a second processing device for workpiece processing, the second processing device defining a processing line, (c) a longitudinal guide comprising a workpiece bed which, together with a workpiece, is movable relative to the cutting device in a first axial direction extending in the longitudinal direction of the processing line, and (d) a transverse guide comprising a workpiece bed which in an operating state is movable together with the workpiece relative to the second processing device and in an inoperative state is movable relative to the workpiece, in each case in a second axial direction extending in a direction transverse to the processing line. The cutting device, together with the workpiece bed of the transverse guide, in the inoperative state, is movable relative to the workpiece in the second axial direction to a processing position, and the workpiece is movable, together with the workpiece bed of the longitudinal guide, relative to the cutting device in the first axial direction.

Because the cutting device is coupled to the workpiece bed of the transverse guide, (a) workpiece movements to be executed in the second axial direction relative to the second processing device, and (b) relative movements of the cutting device and workpieces to be executed in the second axial direction for cutting, can be effected by means of a single drive. Furthermore, only a single, second drive is required for the execution of the necessary relative movements of the workpieces and cutting device in the first axial direction, i.e., along the processing line. Despite their simple constructional form resulting from the minimizing of the number of drive spindles required, the systems disclosed herein are extremely flexibly adaptable to changing operating needs and/or user requirements. For example, the cutting device, transverse guide and first drive may be selectively removable from the system as a first module, and the longitudinal guide and second drive may be selectively removable from the system as a second module.

As a result of the constructional separation of the drive spindle in the longitudinal direction of the processing line from the drive spindle in the direction transverse to the processing line, the system can be selectively with one or with two drive spindles and processing devices respectively. For example, an arrangement which is intended only for bending workpiece processing, and which has only a bending device and a transverse guide serving for handling the workpieces to be processed and also the bent parts, can be supplemented, with little expenditure, with the additional function of "cutting workpiece processing". For this purpose, only a cutting device and, if necessary, a longitudinal guide, need be provided in addition to the components already present. Conversely, an arrangement provided with a cutting and a bending device and also with a longitudinal and a transverse guide can easily be arranged for exclusive bending workpiece processing. It is then only necessary to omit the "cutting device" and "longitudinal guide" components. Function-related redundancies on the "reconstructed" arrangement are avoided.

Some implementations include one or more of the following features. The cutting device may comprise a thermal cutting device, e.g., a laser cutter, or a mechanical cutting device such as guillotine shears. The second processing device may be in the form of a bending device on which a bending line is defined as the processing line.

A common support structure may be provided for the workpiece bed of the transverse guide and for the cutting device. The common support structure may be movable in the second axial direction, together with the workpiece bed of the transverse guide and the cutting device.

In some implementations, the workpiece may be rotatable, by means of the workpiece bed of the transverse guide, about an axis of rotation extending in the transverse direction of the principal plane of the workpiece. The rotational movement of the workpiece effected by means of the workpiece bed of the transverse guide can serve for positioning the workpiece relative to the second processing device and/or for moving the workpiece relative to the cutting device thereby producing a circular cut.

The systems disclosed herein may be automated. For example, a controller (e.g., a digital controller) may be provided by means of which the workpiece movement in the first axial direction and the movement of the cutting device in the second axial direction are controllable. The controller may be configured to allow the workpiece movement in the first axial direction and the movement of the cutting device in the second axial direction to be superposed on each other. With superposition of the movement of the workpiece in the first axial direction and the movement of the cutting device in the second axial direction, cutting lines having a course deviating from the axial directions can be produced on a workpiece to be processed by cutting. In particular, it is possible to cut contours.

The invention also features methods of processing workpieces, and methods of modifying workpiece processing systems, e.g., by selectively adding or removing functionality.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
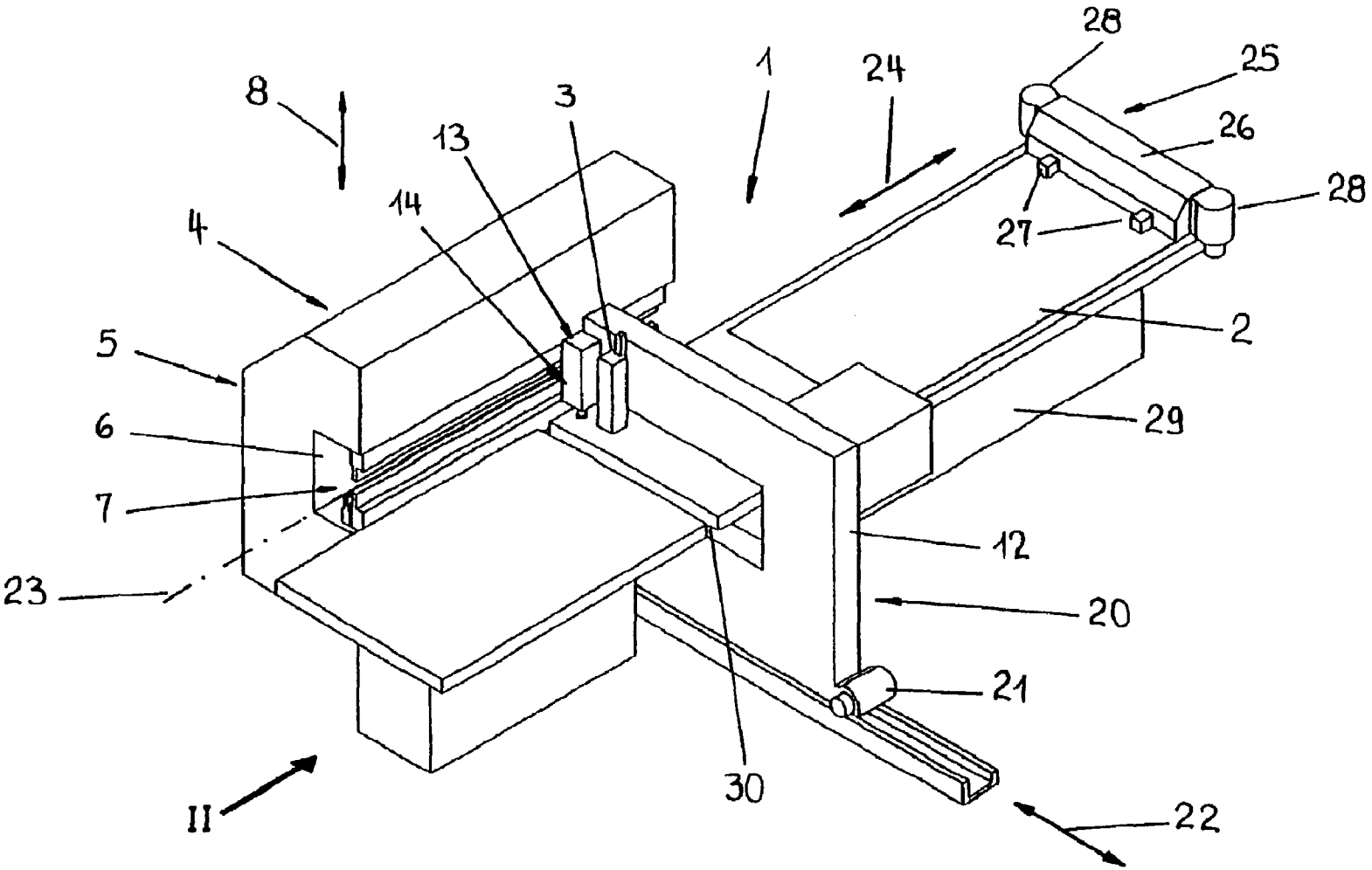
FIG. 1 shows a perspective view of a system for cutting and also for bending workpieces with a longitudinal workpiece guide and a first form of a transverse workpiece guide before the start of a processing phase.
Figure 2:
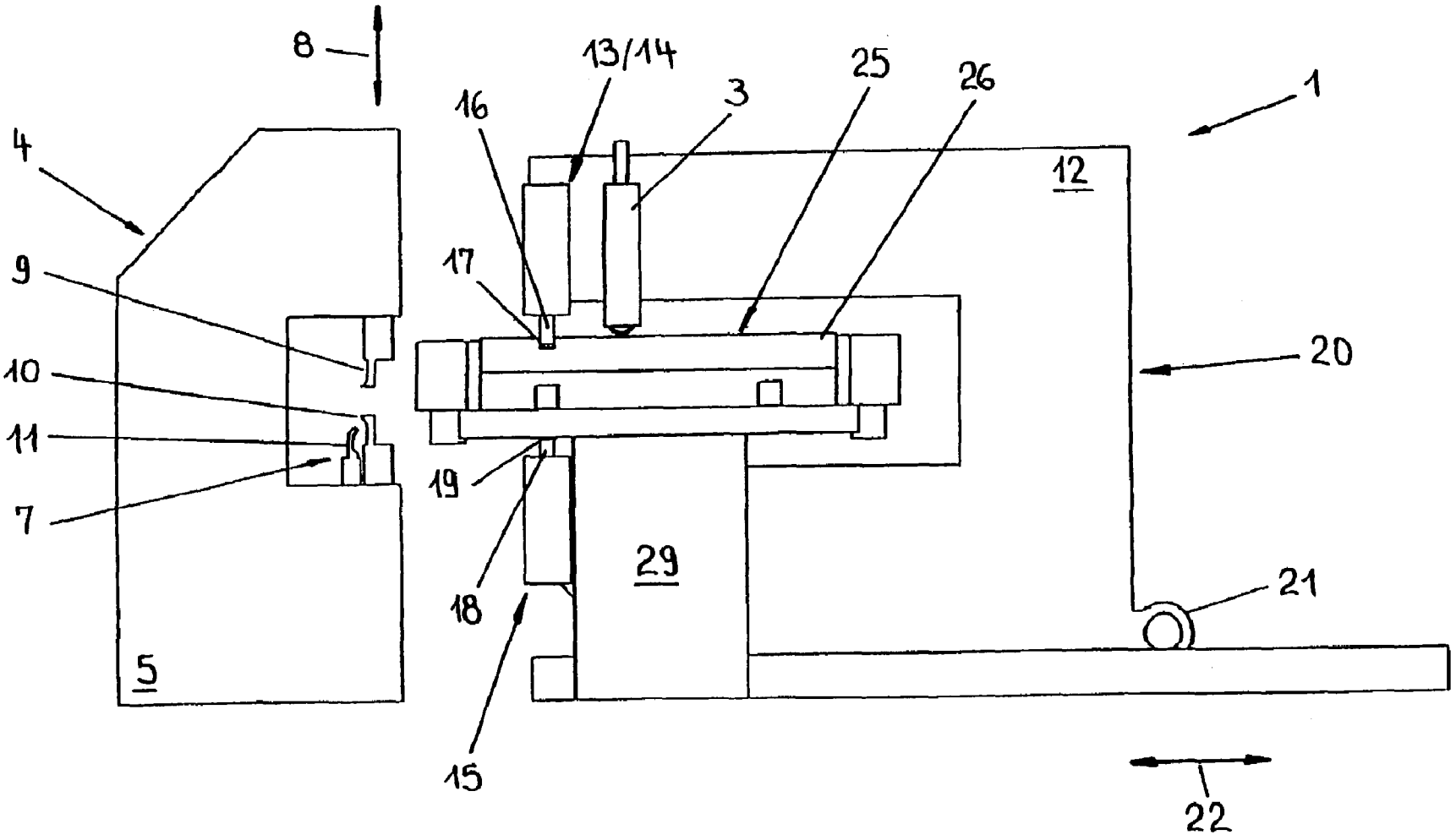
FIG. 2 shows the system according to FIG. 1 in elevation in the direction of the arrow II in FIG. 1, FIGS. 3 to 9 show the system according to FIGS. 1 and 2 in different phases of the workpiece processing.

With reference to FIGS. 1 and 2, a system 1 serves for processing metal sheets 2. For this purpose, the system 1 has a cutting device 3 in the form of a laser cutter and, as a second processing device, a bending device 4. This has a C-shaped machine frame 5 which forms a jaw 6. Arranged in the jaw 6 of the machine frame 5 is a bending tool 7. Referring to FIG. 2, the bending tool 7 comprises a holding-down clamp 9 movably guided in a vertical direction (double arrow 8) on the upper limb of the machine frame 5, a complementary support 10 associated with the holding-down clamp 9 and arranged on the lower limb of the machine frame 5, and also a tangential bending cheek 11.

The cutting device 3 is attached to a support structure in the form of a C-shaped support frame 12. The cutting device 3 is mounted on the upper limb of the support frame 12 so as to be adjustable in a vertical direction 8. Also attached to the support frame 12 is a workpiece holder 13 serving as a workpiece bed. This is formed in two parts and has a holder top part 14, shown in FIG. 1, on the upper limb of the support frame 12, and also a holder bottom part 15, visible in FIG. 2, on the lower limb of the support frame 12. The holder top part 14 has a piston rod 16, movable in a vertical direction 8 and provided at its free end with a contact plate 17. The holder bottom part 15 correspondingly comprises a piston rod 18 movable in a vertical direction 8 and having a contact plate 19.

The support frame 12 and the workpiece holder 13 are parts of a transverse guide 20, which in addition comprises a motor-driven toothed rack drive 21 shown highly diagrammatically in the drawings. By means of the toothed rack drive 21, the support frame 12 and with it the workpiece holder 13 and also the cutting device 3 are movable in an axial direction indicated by means of a double arrow 22. The axial direction 22 extends perpendicularly to a bending or processing line 23 defined on the bending tool 7 of the bending device 4 and indicated by dash-dotted lines in FIG. 1.

Referring to FIGS. 1 and 2, a longitudinal guide 25 acts in the longitudinal direction of the processing line 23, that is to say, in an axial direction 24 indicated by means of a double arrow 24 in FIG. 1. The longitudinal guide 25 comprises a transverse support 26 with two clamping claws 27, providing a workpiece bed. By means of a toothed rack drive 28, the transverse support 26 is movable in the axial direction 24 over a workpiece support 29. The workpiece support 29 has two parts which are separated from each other by means of a gap 30 extending in the axial direction 22 at the level of the workpiece holder 13. The axial directions 22, 24 span a plane which extends parallel to the support plane of the workpiece support 29.

Preferably, all functions and sequences on the system 1 are digitally controlled.

FIG. 1 shows the conditions of the system 1 immediately before the start of processing of the metal sheet 2. The metal sheet 2 has previously been placed on the workpiece support 29 and gripped at one longitudinal end by the clamping claws 27. The lateral overhang of the workpiece support 29 with respect to the machine frame 5 of the bending device 4 in the axial direction 24, and the end of travel position, visible in FIG. 1, of the transverse support 26 of the longitudinal guide 25 on the workpiece support 29 are selected to be such that the workpiece support 29 can be loaded with workpieces of the length of the metal sheet 2 past the machine frame 5 of the bending device 4 in the axial direction 22, and the workpiece in question then comes to rest with its end which faces the transverse support 26 of the longitudinal guide 25 immediately in front of the clamping claws 27. In order to grip the metal sheet 2 with the clamping claws 27, the transverse support 26 of the longitudinal guide 25 consequently has to be moved over only a short distance towards the machine frame 5 of the bending device 4.

In the operating state according to FIGS. 1 and 2, the cutting device 3 is raised with respect to the workpiece support 29. The piston rods 16, 18 of the workpiece holder 13 are retracted, and consequently the workpiece holder 13 is in an inoperative state.

Starting from the conditions according to FIG. 1, the support frame 12 of the transverse guide 20, and with it the cutting device 3 and also the workpiece holder 13 still in the inoperative state, moves in the axial direction 22 towards the machine frame 5 of the bending device 4, until the cutting device 3 assumes a position above the longitudinal edge of the metal sheet 2 facing towards the machine frame 5 of the bending device 4. At the same time, the transverse support 26 of the longitudinal guide 25, together with the metal sheet 2, is moved in the axial direction 24 towards the free longitudinal end of the workpiece support 29, until the metal sheet 2 is positioned in the required manner in the axial direction 24 with respect to the cutting device 3. The free end of the metal sheet 2 projects beyond the side of the support frame 12 of the transverse guide 20 facing away from the transverse support 26 of the longitudinal guide 25. By lowering the cutting device 3 in a vertical direction 8, the focus position of the cutting device 3 in the form of a laser cutter is now adjusted with respect to the metal sheet 2. After the focus position has been adjusted, the cutting device 3 is switched on and, by movement of the support frame 12 of the transverse guide 20 in the axial direction 22, with the workpiece holder 13 still in the inoperative state and the metal sheet 2 stationary, is moved away from the machine frame 5 of the bending device 4 over a defined distance. By this means, on the metal sheet 2 a cut is produced which extends in a straight line in the axial direction 22 and ends within the metal sheet 2.

Figure 3:
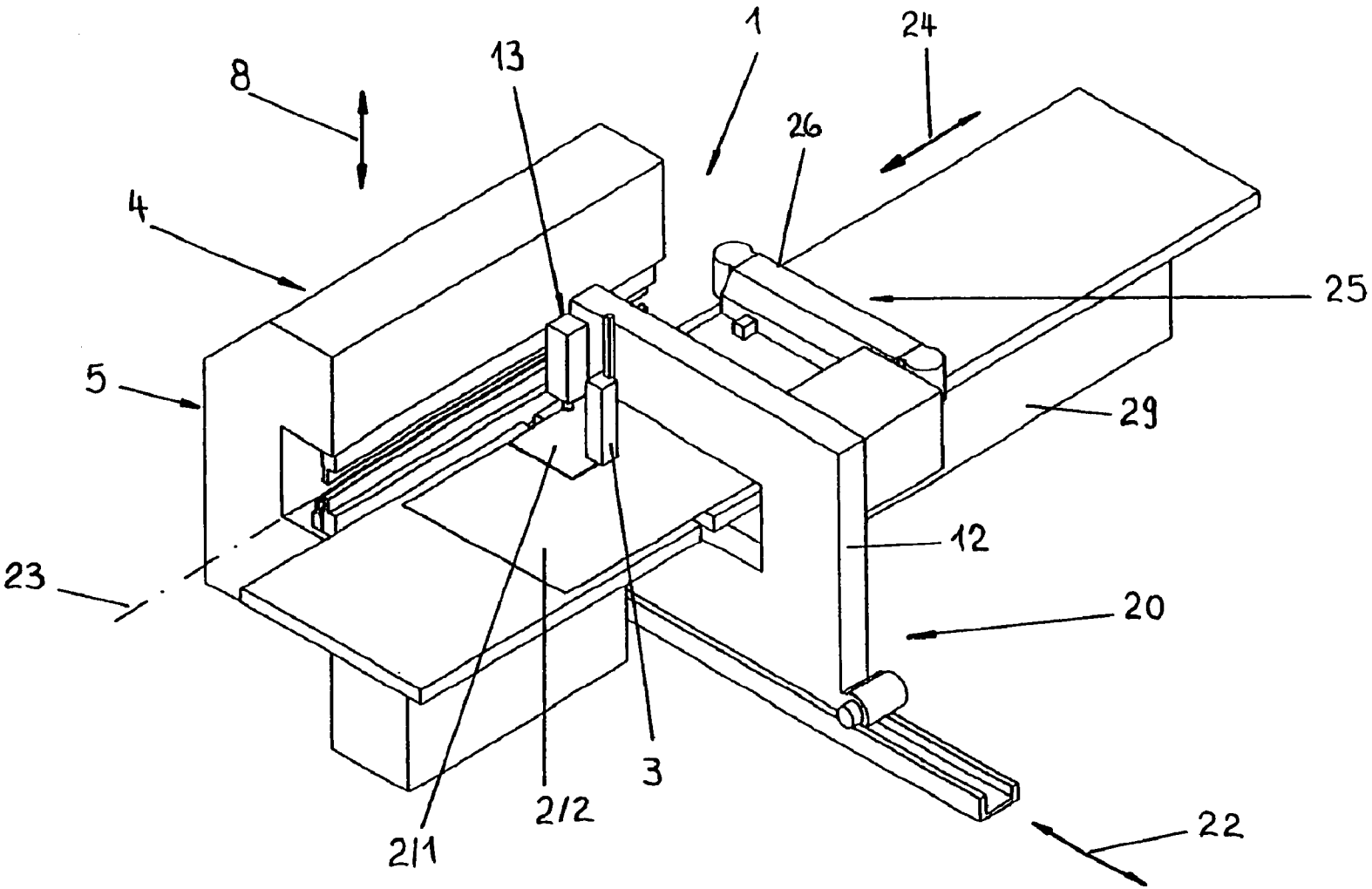

With the support frame 12 stationary in the axial direction 22, while the cutting device 3 is still switched on, and the workpiece holder 13 is still in the inoperative state, the transverse support 26 of the longitudinal guide 25, together with the metal sheet 2, is now moved in the axial direction 24 towards the free end of the workpiece support 29. Along with this, a cut extending in a straight line in the axial direction 24 is made on the metal sheet 2. This longitudinal cut ends at a right angle to the cut, first produced, extending in the axial direction 22. The system 1 in FIG. 3 is shown during the production of the cut extending in the axial direction 24.

When the cut in the axial direction 24 has reached the desired length, the movement of the transverse support 26 and the metal sheet 2 stops. The support frame 12, with the cutting device 3 switched on, now travels in the axial direction 22 towards the machine frame 5 of the bending device 4. The travel movement of the support frame 12 and the cutting device 3 ends as soon as the cut produced during the travel movement of the cutting device 3 and extending in the axial direction 22 opens into the longitudinal edge of the metal sheet 2 lying towards the machine frame 5 of the bending device 4.

On the metal sheet 2, a sheet portion 2/1 is now cut out, which at first still lies within a residual sheet 2/2.

After the separating cut has been completed, the cutting device 3 is raised in a vertical direction 8. At the same time, the support frame 12, with the cutting device 3 and the workpiece holder 13, still in the inoperative state, travels in the axial direction 22 to the side lying away from the machine frame 5 of the processing device 4 until the workpiece holder 13 comes to rest at the level of the edge of the sheet portion 2/1 extending in the axial direction 24. The piston rods 16, 18 of the workpiece holder 13 now extend and bring the contact plates 17, 18 attached to their free ends to bear against the sheet portion 2/1. In so doing, the piston rod 18 and the contact plate 19 move into the gap 30 of the workpiece support 19. The sheet portion 2/1 is now clamped between the holder top part 14 and the holder bottom part 15. The workpiece holder 13 is in its operating state.

Starting from these conditions, the support frame 12, with the workpiece holder 13 in the operating state and the sheet portion 2/1 fixed thereto, is moved in the axial direction 22 towards the machine frame 5 of the bending device 4. The sheet portion 2/1 is by this means pushed out of the cutaway portion of the residual sheet 2/2 accommodating the sheet portion 2/1. The sheet portion 2/1 is shown in an intermediate position within the cutaway portion on the residual sheet 2/2 in FIG. 4.

Figure 4:
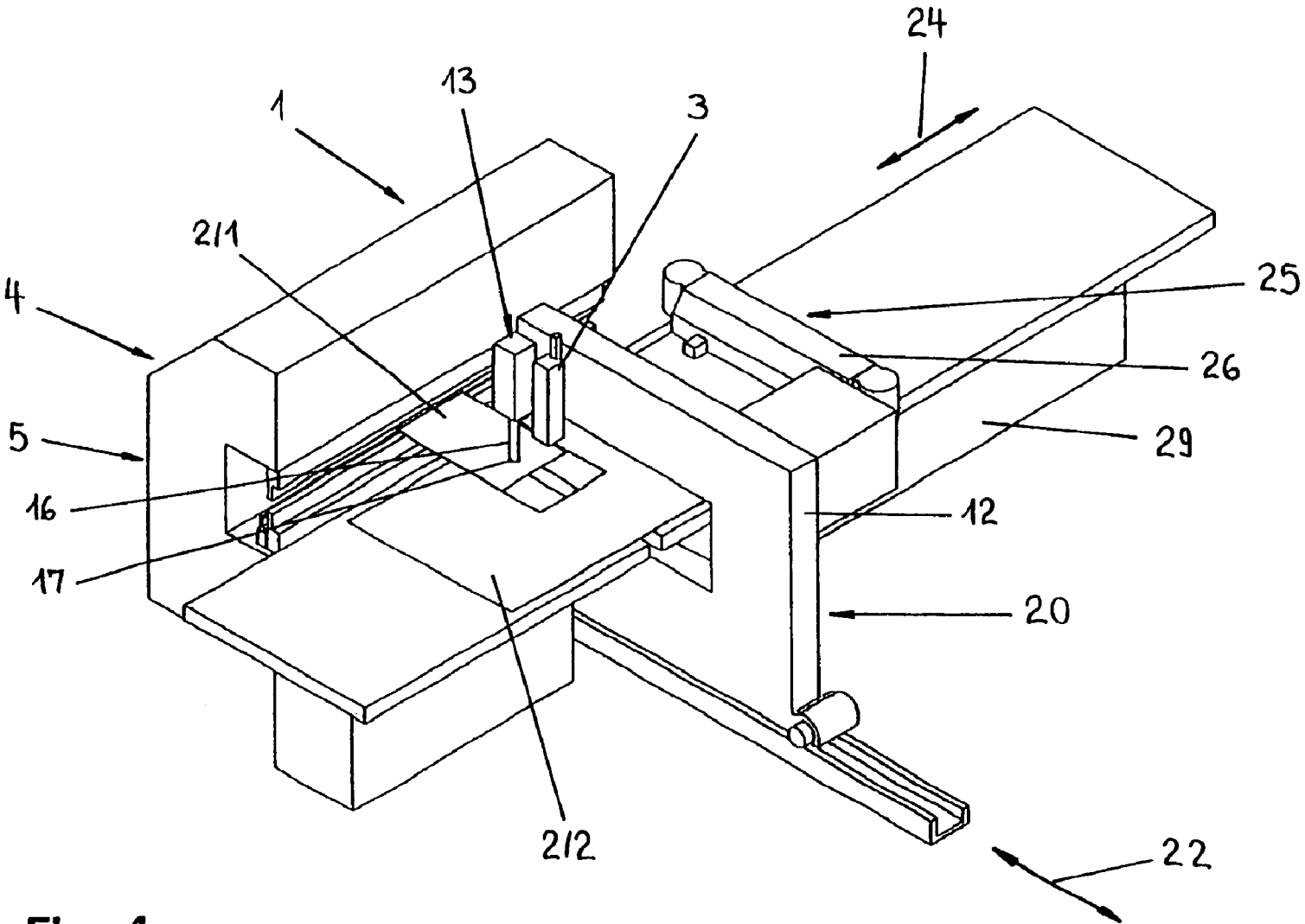

Beyond the position shown in FIG. 4, the sheet portion 2/1 is pushed towards the machine frame 5 of the bending device 4 until it has completely left the cutaway portion on the residual sheet 2/2. The transverse support 26 of the longitudinal guide 25 is now moved back in the axial direction 24 into its initial position. The residual sheet 2/2 moves past the sheet portion 2/1 fixed by means of the workpiece holder 13 and projecting far into the jaw 6 of the machine frame 5 of the bending device 4.

As soon as the residual sheet 2/2 has passed the sheet portion 2/1, the support frame 12, with the sheet portion 2/1, travels back from the machine frame 5 of the bending device 4 in the axial direction 22. The travel movement of the support frame 12 ends as soon as the sheet portion 2/1 assumes its correct position with respect to the bending tool 7, in detail with respect to the processing or bending line 23. The operating state then existing is shown in FIGS. 5 and 6.

Figure 5:
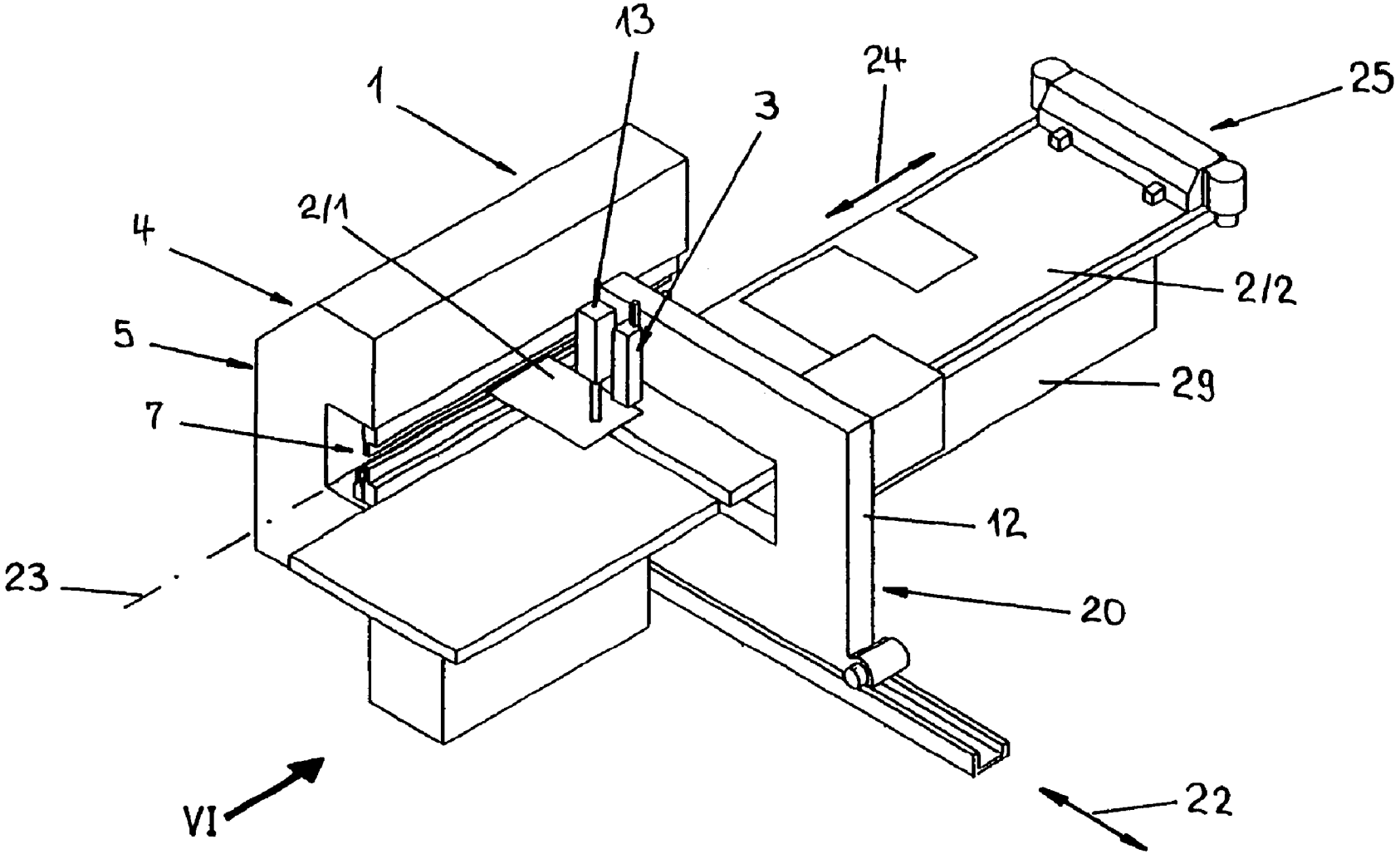
Figure 6:
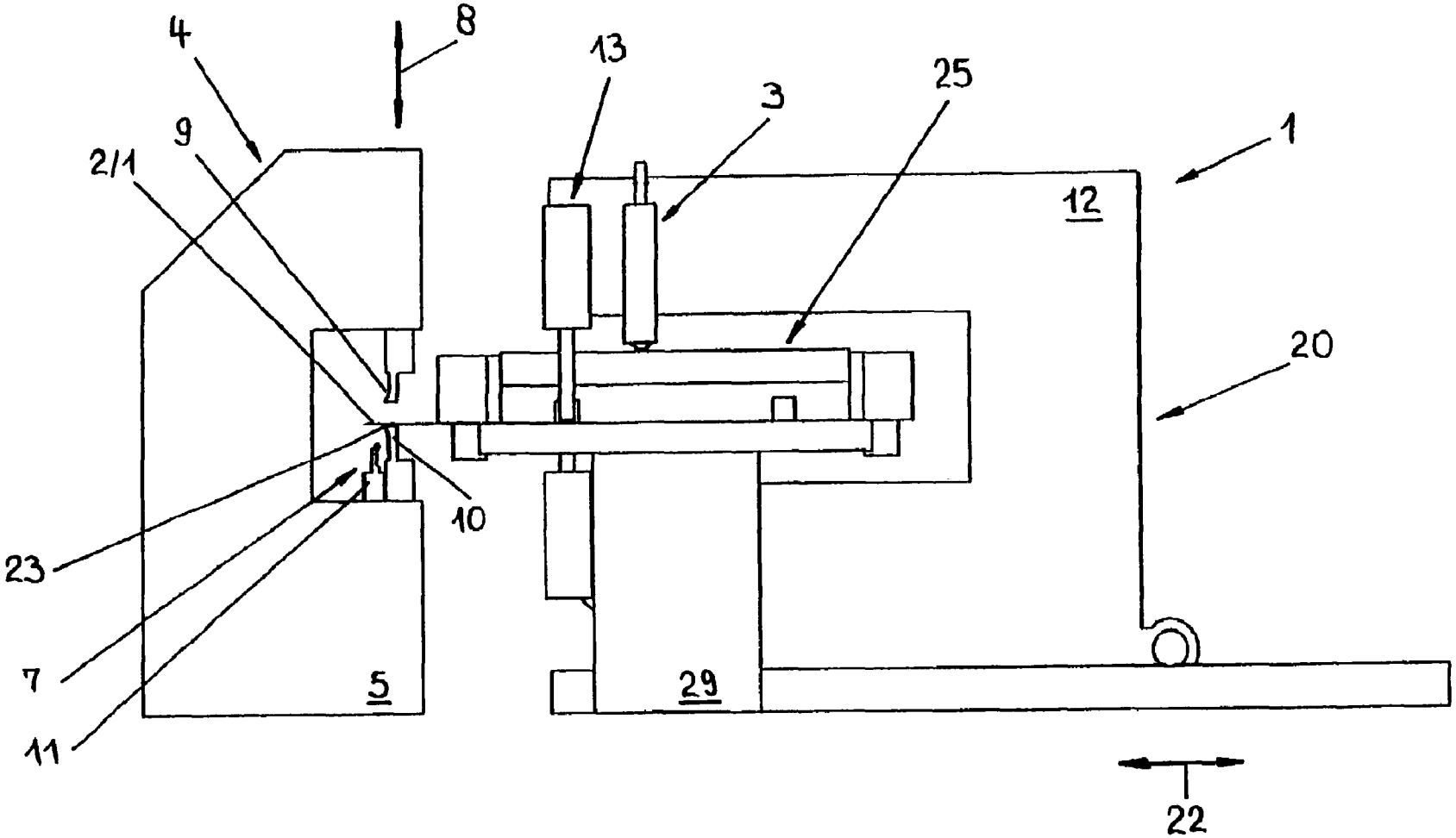

FIG. 6 shows the conditions according to FIG. 5 in side view in the direction of the arrow VI in FIG. 5. The still flat sheet portion 2/1 lies on the complementary support 10 of the bending tool 7. The holding-down clamp 9 and also the tangential bending cheek 11 of the bending tool 7 are in their initial positions.

Figure 7:
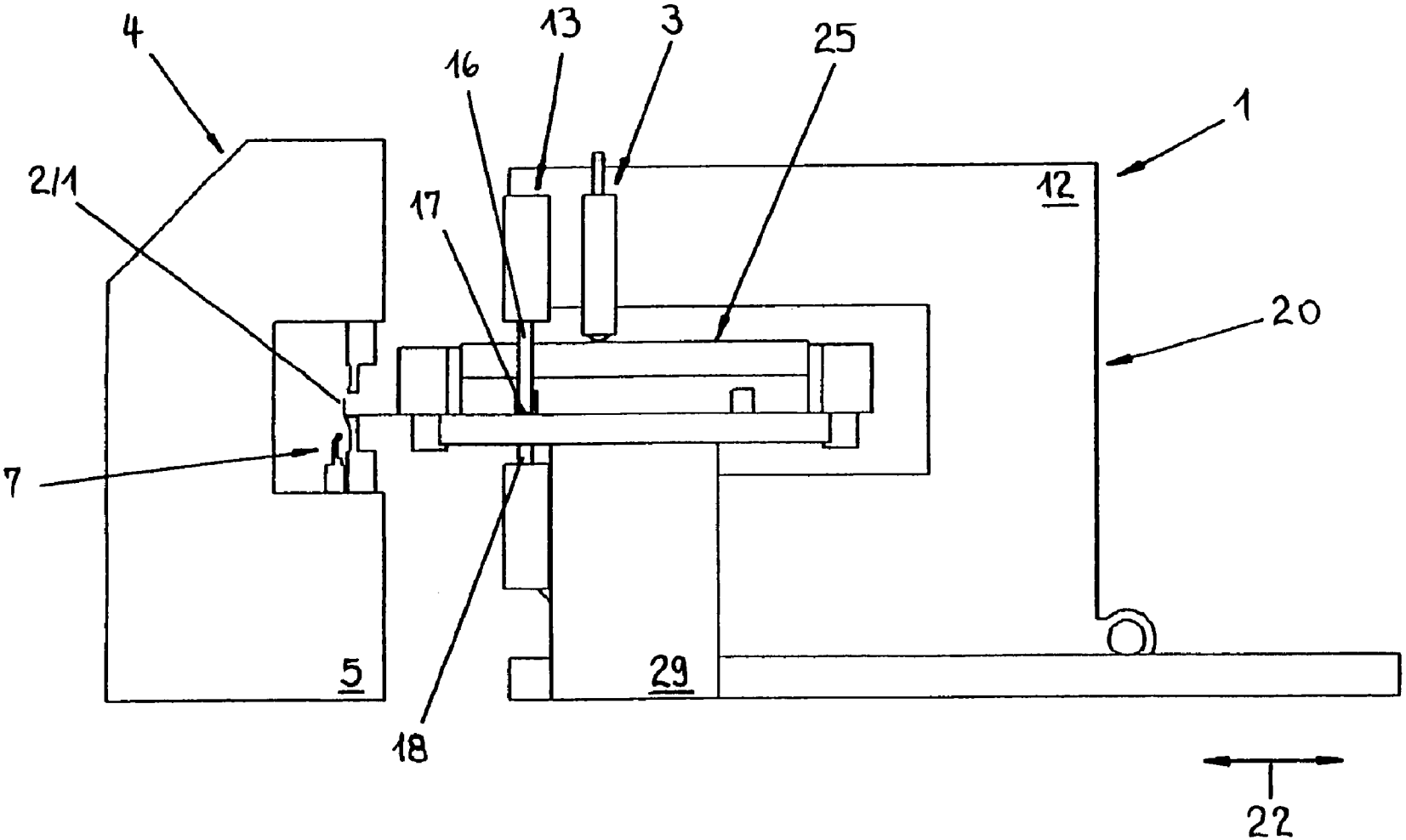

The holding-down clamp 9 is now lowered in a vertical direction 8. By this means the sheet portion 2/1 is clamped between the holding-down clamp 9 and the complementary support 10. The tangential bending cheek 11 then executes its working movement and in so doing folds the sheet portion 2/1 along the processing line 23. The holding-down clamp 9 is then raised again into its initial position. The conditions resulting therefrom can be seen in FIG. 7.

Figure 8:
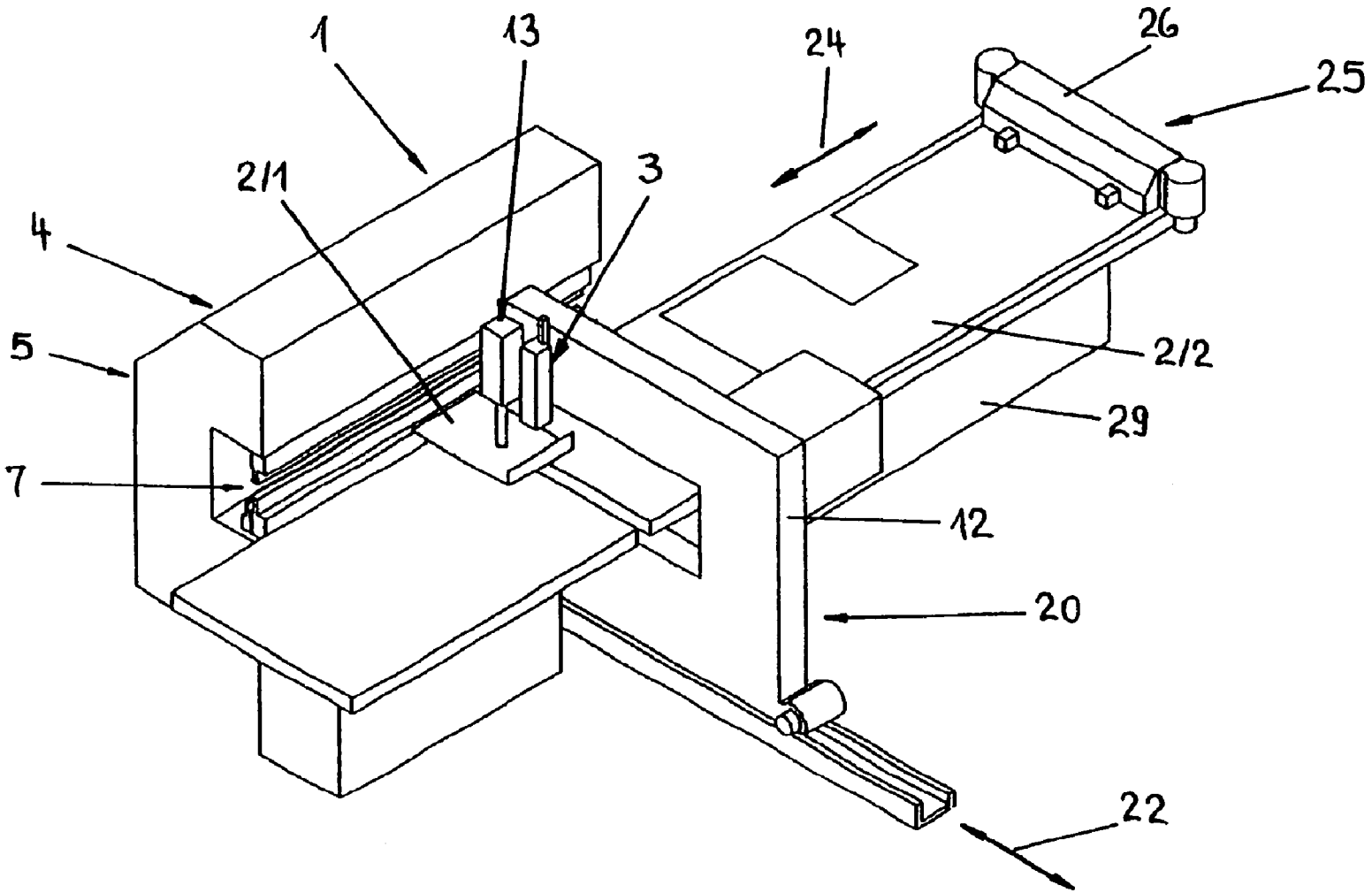

By means of a rotary drive not shown in detail, the contact plates 17, 19 of the workpiece holder 13, together with the clamped sheet portion 2/1, are now rotated through 180° about a vertical axis of rotation. The folded edge of the sheet portion 2/1 comes to rest outside the jaw 6 of the machine frame 5 of the bending device 4 (FIG. 8).

By means of renewed travel of the support frame 12 with the sheet portion 2/1 in the axial direction 22 towards the machine frame 5 of the bending device 4, the longitudinal edge of the sheet portion 2/1 lying opposite the already folded longitudinal edge can now also be transferred to a processing position with respect to the bending tool 7 of the bending device 4. In the manner described previously, the edge lying opposite the already folded edge of the sheet portion 2/1 can now also be folded. Finally, the sheet portion 2/1, folded on both longitudinal edges, is removed from the bending device 4 by means of corresponding travel of the support frame 12 in the axial direction 22. The processed sheet portion 2/1 can then be removed, for example manually, from the system 1.

Figure 9:
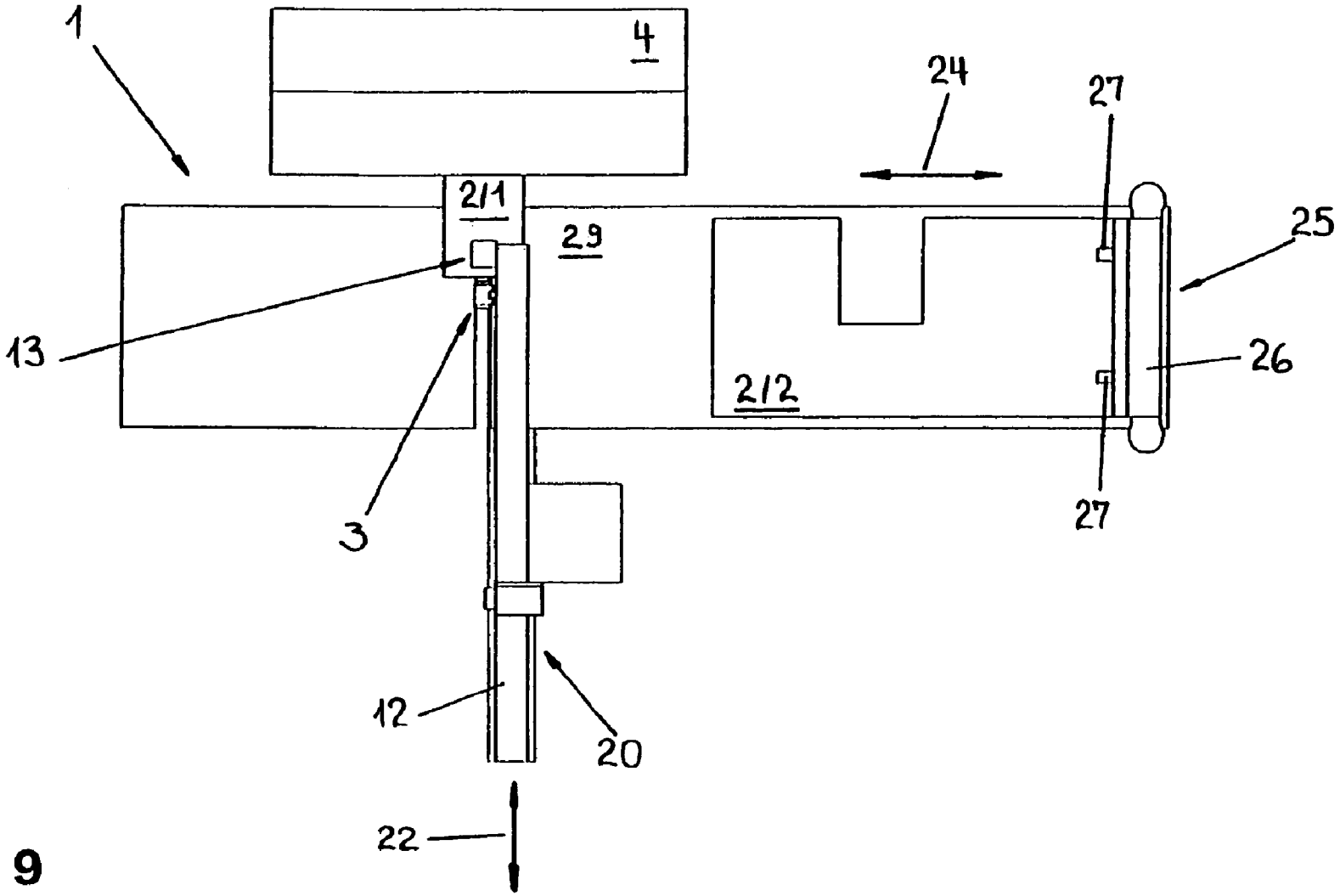

The residual sheet 2/2, still supported on the workpiece support 29, can either be processed further or removed from the workpiece support 29. As FIG. 9 shows, in the plan view of the workpiece support 29, the residual sheet 2/2 can also be moved laterally (direction 22) past the machine frame 5 of the bending device 4 for removal from the workpiece support 29.

Figure 10:
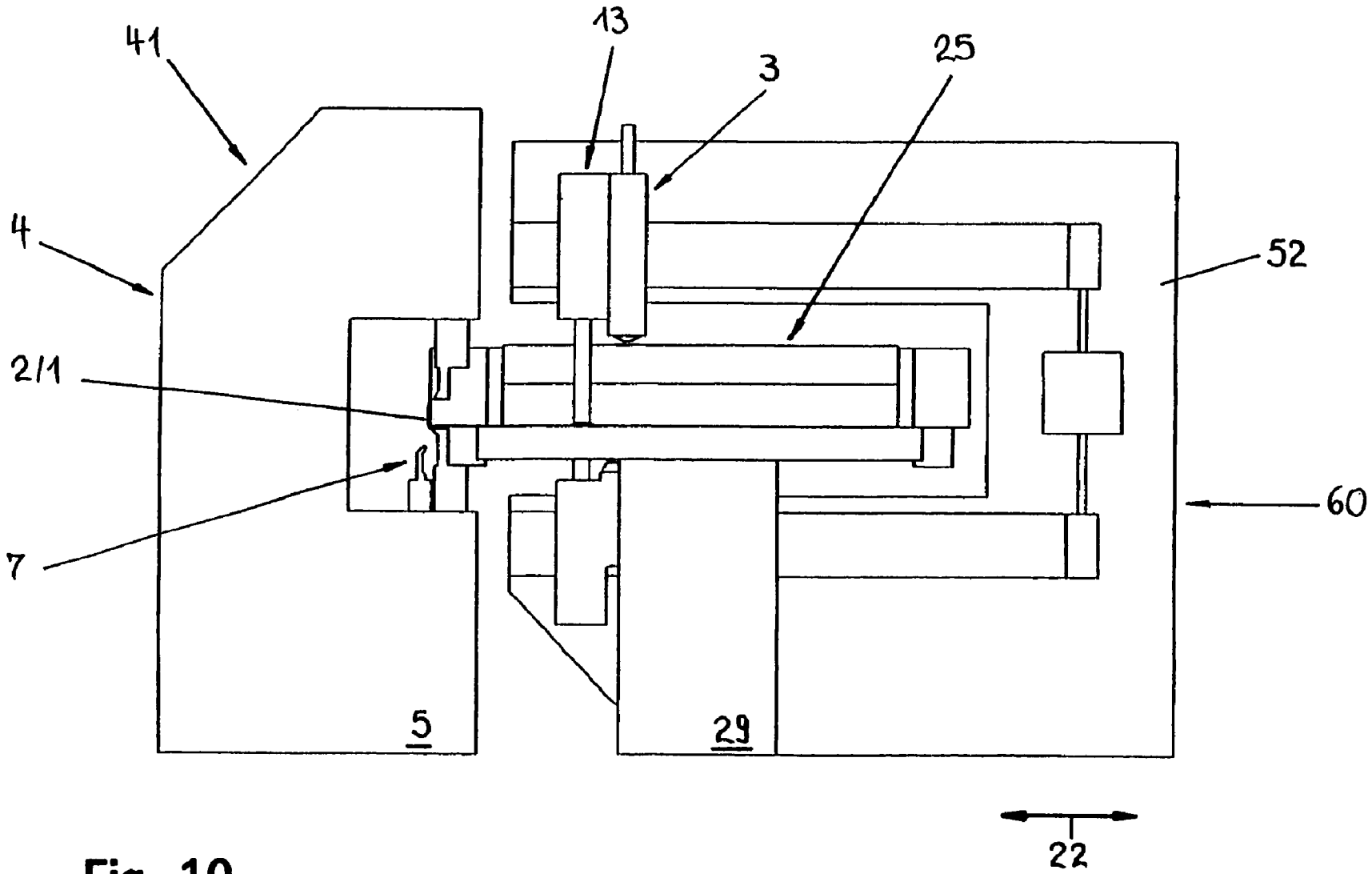
FIG. 10 shows a system for cutting and also for bending workpieces with a longitudinal workpiece guide and a second form of a transverse workpiece guide.

A system 41 as shown in FIG. 10 differs from the system 1 according to FIGS. 1 to 9 only with regard to the travel drive for the workpiece holder 13 and the cutting device 3. Differing from the conditions according to FIGS. 1 to 9, the system 41 comprises a transverse guide 60 with a stationary support frame 52. The workpiece holder 13 and the cutting device 3 are movable together on the stationary support frame 52 in the axial direction 22.

A number of embodiments of the invention have been described. Nevertheless, it will be understood that various modifications may be made without departing from the spirit and scope of the invention. Accordingly, other embodiments are within the scope of the following claims.

What is claimed is:

1. A system for processing plate-like workpieces comprising, a first processing device comprising a cutting device, a second processing device defining a processing line, a longitudinal guide comprising a workpiece bed which, together with a workpiece, is movable relative to the cutting device in a first axial direction extending in the longitudinal direction of the processing line, and a transverse guide, comprising a workpiece bed, which in an operating state is movable together with the workpiece relative to the second processing device, and in an inoperative state is movable relative to the workpiece, in each case in a second axial direction extending in a direction transverse to the processing line, wherein when the workpiece bed of transverse guide is in the inoperative state, the cutting device, together with the workpiece bed of the transverse guide, is movable relative to the workpiece in the second axial direction to a processing position, and the workpiece is movable, together with the workpiece bed of the longitudinal guide, relative to the cutting device in the first axial direction into a processing position.

2. A system according to claim 1, characterized in that the cutting device comprises a thermal cutting device.

3. A system according to claim 2 wherein the cutting device comprises a laser cutter.

4. A system according to claim 1 wherein the cutting device comprises guillotine shears.

5. A system according to claim 1, characterized in that the second processing device is in the form of a bending device on which a bending line is defined as the processing line.

6. A system according to claim 1, characterized in that a common support structure is provided for the workpiece bed of the transverse guide and for the cutting device.

7. A system according to claim 6, characterized in that the common support structure is movable in the second axial direction, together with said workpiece bed of the transverse guide and said cutting device.

8. A system according to claim 1, characterized in that the workpiece is rotatable, by the workpiece bed of the transverse guide.

9. A system according to claim 8, wherein the workpiece bed of the transverse guide is constructed to rotate the workpiece about an axis of rotation extending in the transverse direction of the principal plane of the workpiece.

10. A system according to claim 1, characterized in that a controller is provided by means of which the workpiece movement in the first axial direction and the movement of the cutting device in the second axial direction are controllable.

11. A system according to claim 10, characterized in that by means of the controller the workpiece movement in the first axial direction and the movement of the cutting device in the second axial direction can be superposed on each other.

12. A system according to claim 10 in which the controller comprises a digital controller.

13. A system according to claim 1 wherein the cutting device is operable to cut a first portion of the workpiece from a second portion of the workpiece, and the workpiece bed of the transverse guide, in the operating state, is movable to separate the first and second portions.

14. A system according to claim 1 wherein the workpiece comprises a metal sheet.

15. A system according to claim 1 wherein the cutting device and the transverse guide are operated by a first drive, and the longitudinal guide is operated by a second drive.

16. A system according to claim 15 wherein the second processing device, transverse guide and first drive are selectively removable from the system as a first module, and the cutting device, the longitudinal guide and the second drive are selectively removable from the system as a second module.

17. A method of processing a workpiece, using a system comprising a first processing device including a cutting device, and a second processing device defining a processing line, the method comprising loading the workpiece onto a support comprising a longitudinal guide, moving the workpiece relative to the cutting device in a first axial direction extending in the longitudinal direction of the processing line, using the longitudinal guide, placing a workpiece bed of a transverse guide in an inoperative state and moving the cutting device, together with the workpiece bed of the transverse guide in the inoperative state, relative to the workpiece in a second axial direction, transverse to the processing line, to a processing position, performing a processing operation on the workpiece with the cutting device while the workpiece bed of the transverse guide is in an inoperative state and the cutting device is moving, placing the workpiece bed of the transverse guide in an operating state with respect to the workpiece, and moving the workpiece relative to the second processing device, in the second axial direction, while the workpiece bed of the transverse guide is in the operating state, and performing a second processing operation on the workpiece with the second processing device.

18. A system for processing plate-like workpieces comprising, a first processing device comprising a cutting device, a second processing device defining a processing line, a longitudinal guide comprising a workpiece bed, and a transverse guide comprising a workpiece bed, which in an operating state is movable together with the workpiece relative to the second processing device, and in an inoperative state is movable relative to the workpiece, in each case in a second axial direction extending in a direction transverse to the processing line, wherein the cutting device and the workpiece bed of the transverse guide are mounted on a common support structure and driven by a common drive.

* * * * *